US005129330A

United States Patent [19]

McKay et al.

[11] Patent Number: 5,129,330

[45] Date of Patent: Jul. 14, 1992

[54] CURRENCY SECURITY BOX

[75] Inventors: Linn A. McKay, Henderson; Frank C. DeSimone, Las Vegas, both of Nev.

[73] Assignee: Sigma Game, Inc., North Las Vegas, Nev.

[21] Appl. No.: 717,967

[22] Filed: Jun. 20, 1991

[51] Int. Cl.[5] ..... E05G 1/04

[52] U.S. Cl. ..... 109/59 R; 70/63; 232/15; 232/43.1

[58] Field of Search ..... 109/38, 45, 50–52, 109/56–59, 64, 66, 70, 73, 74; 70/57, 58, 63, DIG. 41; 232/15, 16, 31, 43.1, 43.3, 14

[56] References Cited

U.S. PATENT DOCUMENTS

| | | | |
|---|---|---|---|
| 3,083,896 | 4/1963 | Cairelli et al. | 70/63 X |
| 3,670,955 | 6/1972 | Dominick et al. | 232/16 X |
| 3,807,628 | 4/1974 | Bock | 232/16 |
| 3,841,550 | 10/1974 | Kaneda et al. | 232/14 X |
| 3,843,043 | 10/1974 | Sciortino | 232/31 X |
| 3,933,240 | 1/1976 | Humble | 70/63 X |
| 4,186,977 | 2/1980 | Gilovich et al. | 232/15 X |
| 4,194,683 | 3/1980 | Finke et al. | 232/15 |
| 4,370,006 | 1/1983 | Graef et al. | 232/15 X |
| 4,434,931 | 3/1984 | Hunt et al. | 232/15 |
| 4,545,475 | 10/1985 | Fillod et al. | 232/43.1 X |
| 4,638,746 | 1/1987 | Ishigure | 232/15 X |
| 4,942,954 | 7/1990 | Nesser et al. | 232/15 X |
| 4,949,901 | 8/1990 | Harris | 232/1 D X |
| 5,009,365 | 4/1991 | Holtzer | 232/16 |

*Primary Examiner*—Renee S. Luebke
*Assistant Examiner*—Suzanne L. Dino
*Attorney, Agent, or Firm*—Skjerven, Morrill, MacPherson, Franklin & Friel

[57] ABSTRACT

In the preferred embodiment of the invention, a currency security box is releasably secured to a frame within a device, such as a vending machine, gaming machine, gaming table, amusement machine, bank machine or the like, and is automatically released from the frame by sliding a transportable security box cover over the security box. At the position where the security box cover releases the box from the frame, the security box cover also effectively encloses the security box and automatically latches onto the security box. The security box, along with the security box cover, may now be removed from the frame and the device. The security box cover includes a locking device which must be activated to release the security box cover from the security box so as to gain access to the currency in the box.

12 Claims, 3 Drawing Sheets

CURRENCY SECURITY BOX

FIELD OF THE INVENTION

This invention relates to a currency security box which may be used in machines which accept bills, coins, tokens, chips, or similar type items to operate the machine.

BACKGROUND OF THE INVENTION

A currency security box is incorporated in a variety of devices where a user deposits bills or coins through a port in the device to actuate the device. Frequently, these currency security boxes accept bills, coins, tokens, or chips which have been first validated by an appropriate validator. In certain situations, these currency security boxes require a locking device to allow access to the deposited currency only by authorized personnel.

Since a person authorized to gain access to the internal structure of the device containing the locked security boxes may not have the additional authority to gain access to the currency inside the security box, it is desirable to provide a convenient means for allowing such a person to remove the locked security box from the device so that the locked box may be opened by an authorized person at a location remote from the device.

SUMMARY OF THE INVENTION

The invention is an improved currency security box which may be quickly and easily removed from a device containing the box and which is locked when removed from the device. The security box may then be later unlocked by an authorized person to gain access to currency or other items of value contained in the box.

In the preferred embodiment of the invention, a currency security box is releasably secured to a frame or support structure within a device, such as a vending machine, gaming machine, amusement machine, gaming table, arcade machine, or bank machine. The security box is automatically released from the frame by sliding a transportable security box cover over the security box.

At the time the security box cover releases the box from the frame, the security box cover has also effectively enclosed the security box and automatically latched onto the security box. The security box cover includes a locking device which must be activated to release the security box cover from the security box so as to gain access to the currency in the box.

After the security box cover has enclosed the box and released the box from the frame, the security box and the security box cover may now be removed from the machine and transported to a remote area where an authorized person would then disengage the security box cover from the security box by a key or combination to gain access to the currency within the security box.

DETAILED DESCRIPTION OF THE PREFERRED EMBODIMENT

Figure 1:
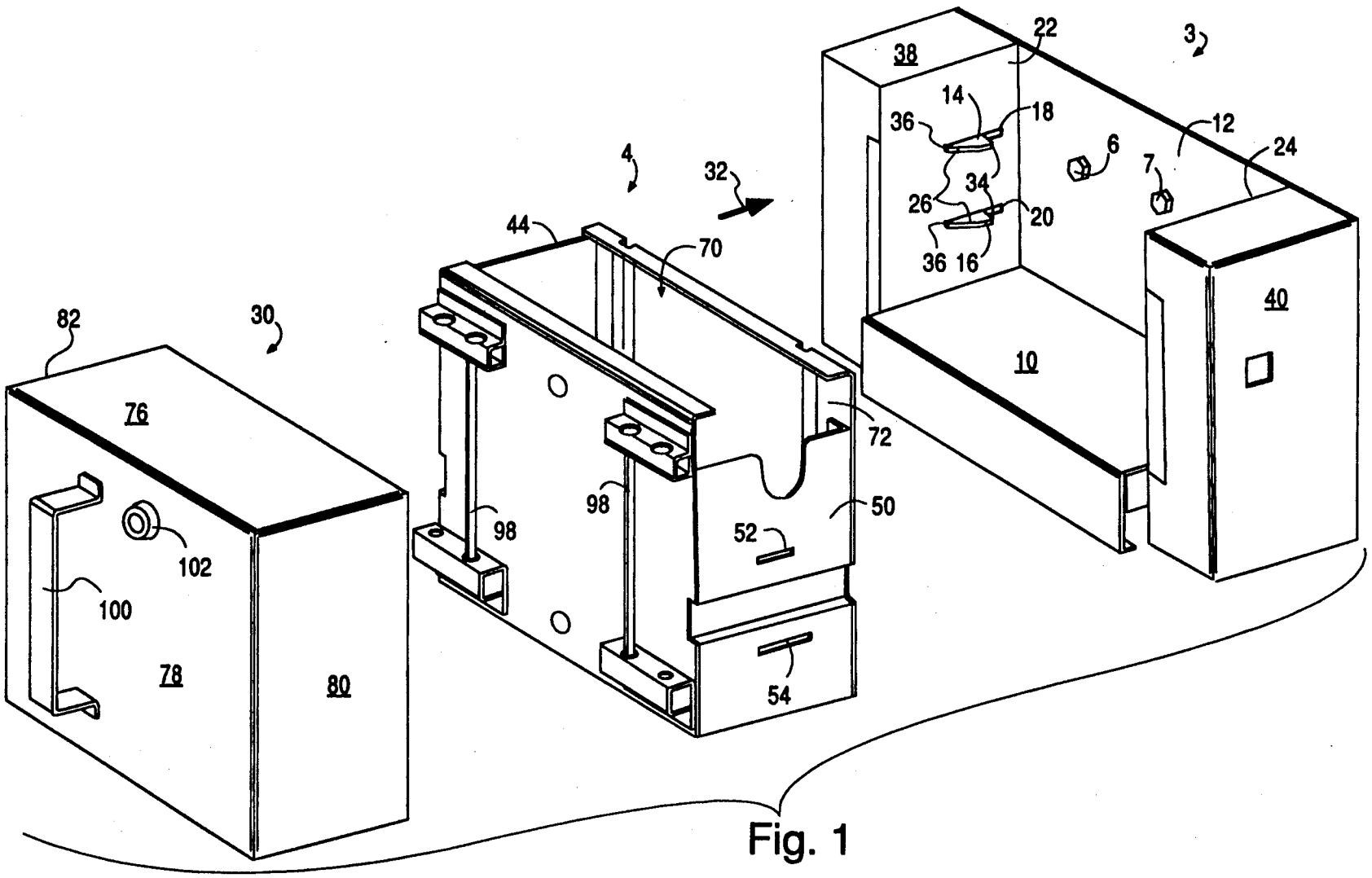
FIG. 1 shows the interaction of the security box cover, the security box, and the frame used in the preferred embodiment of the invention.

FIG. 1 shows frame 3 which may be secured within any device in which currency or other items of value are inserted to operate the device. Such a device may be a vending machine, a gaming machine, a bill changer or any other machine.

Securing frame 3 within such a device is preferably done so as to prevent easy removal of frame 3 from the device by unauthorized personnel when currency security box 4 is latched onto frame 3. One such means of securing frame 3 within a device may be via bolts 6 and 7 which may only be unscrewed after security box 4 has been removed from the device. Other means of securing frame 3 within a device may be more applicable depending on the particular environment of the device, and such means for securing would be apparent to one of ordinary skill in the art.

All portions of frame 3 may be made of a suitable sheet metal.

Frame 3 includes a base 10 onto which security box 4 sits after being slid into position against back wall 12 of frame 3.

Spring-loaded latches 14 and 16 are shown protruding from slots 18 and 20, respectively, formed in left sidewall 22 of frame 3. An identical latch and slot structure is provided in right sidewall 24 of frame 3. Spring-loaded latches 14 and 16 each have an angled edge 26 to more easily enable security box 4 and security box cover 30, when slid in the direction of arrow 32, to push spring-loaded latches 14 and 16 further into slots 18 and 20 to accomplish the required latching and releasing operations to be described later.

Latches 14 and 16 have a rear blocking edge 34, approximately perpendicular to left sidewall 22, for securing security box 4 in place when properly slid into position in frame 3.

Latches 14 and 16 also have a front blocking edge 36, approximately perpendicular to left sidewall 22, which contacts a front edge of slots 18 and 20 for preventing forward movement of latches 14 and 16 in a direction opposite to arrow 32.

Figure 3A:
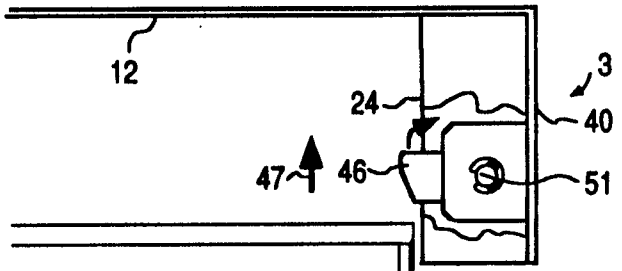
FIGS. 3*a* and 3*b* further illustrate the latching action of the frame.

Left spring housing 38 and right spring housing 40 house the mechanisms which resiliently support the latches protruding from left sidewall 22 and right sidewall 24, as will be discussed in more detail with respect to FIGS. 3*a* and 3*b*.

As shown in FIG. 1, security box 4 is sized so as to be slid into place along base 10 of frame 3 against back wall 12 between left sidewall 22 and right sidewall 24. In the preferred embodiment shown in FIG. 1, currency security box 4 is essentially rectangular; however, security box 4 may be of any suitable shape to match the shape of any suitable frame, shown in one embodiment as frame 3. Currency security box 4, shown in FIG. 1, may be made of a durable metal of sufficient thickness to provide the desired mechanical strength.

As security box 4 is slid into place in frame 3 in the direction of arrow 32, latches 14 and 16 along left sidewall 22 are pushed within slots 18 and 20 of left sidewall 22 by being contacted by left sidewall 44 of security box 4. The same operation occurs with latches protruding from right sidewall 24 of frame 3 being contacted by right sidewall 50 of security box 4. This operation is illustrated in FIG. 3*a*, where a top view of latch 46, protruding from right sidewall 24 of frame 3, is shown prior to being contacted by right sidewall 50 of security box 4. When box 4 is slid in the direction of arrow 47, right sidewall 50 of box 4 pushes against latch 46, and spring-loaded latch 46 moves in a clockwise direction around axis 51.

Figure 3B:
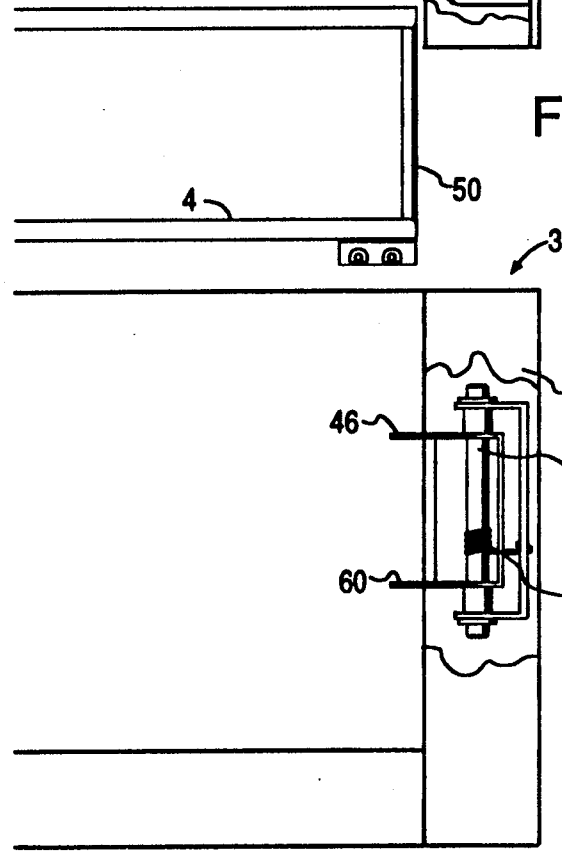

FIG. 3*b* is a cutaway front view of right spring housing 40, which shows the spring loading of latches 46 and 60, whereby latches 46 and 60 may be formed of a single piece of metal. Latches 46 and 60 may be formed to rotate about axis 51 and are spring loaded by means of spring 62.

Both left sidewall 44 and right sidewall 50 of box 4 have slots formed therein such as slots 52 and 54 shown in FIG. 1. When security box 4 is slid into place against back wall 12 of frame 3, the slots, such as slots 52 and 54, align with the latches protruding from the respective sidewalls of frame 3 so that the spring-loaded latches enter the respective slots formed in the sidewalls of security box 4.

Figure 2:
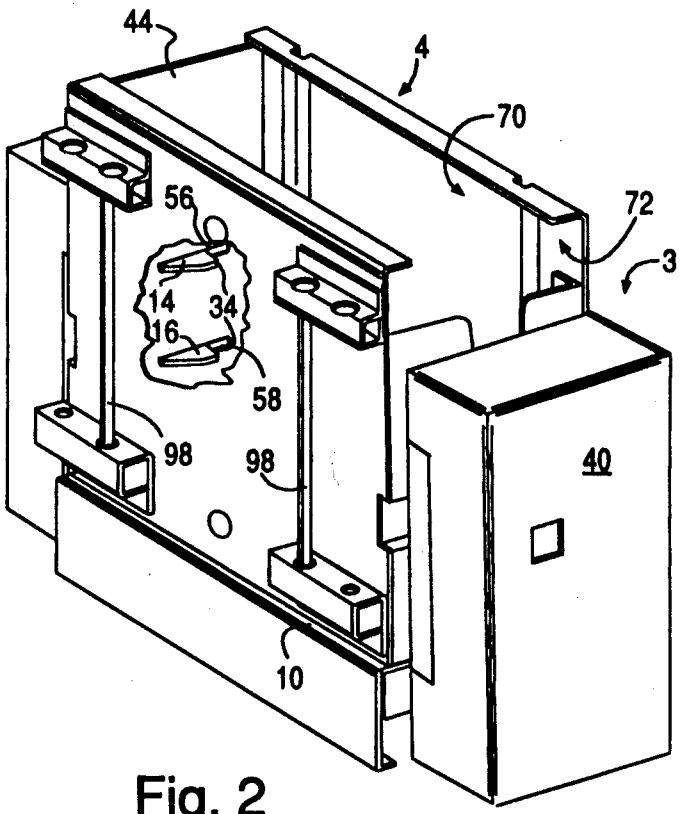
FIG. 2 illustrates the automatic latching of the security box to the frame when the security box is slid into position in the frame.

As shown in FIG. 2, once the spring-loaded latches enter the respective slots in security box 4, security box 4 is then latched in place. Security box 4 is now blocked from being slid out of frame 3 by rear edges 34 of latches 14 and 16 coming into contact with the edges of slots 56 and 58 formed in left sidewall 44 of security box 4.

Frame 3 and security box 4 are preferably located within a device such that, after a bill, coin, token, or chip is inserted into the device by a user, a validator deposits any inserted currency or other item into security box 4. This may be accomplished by positioning the validator so that any currency or other item will drop into security box 4 through top opening 70 or side opening 72 shown in FIGS. 1 and 2. Security box 4 may be designed to accept currency or other items from virtually any validator.

Preferably, frame 3 is positioned within a device such that, when security box 4 is in place and the device is opened to gain access to its internal structure, access cannot be gained to the currency within security box 4 by one who only has access to the internal structure of the device. This may be accomplished by providing a structure which would not allow a person to reach through openings 70 or 72 when box 4 is positioned in frame 3. For example, openings 70 or 72 may be blocked by a cover or by an overhanging portion of frame 3 itself when box 4 is secured to frame 3.

Figure 4:
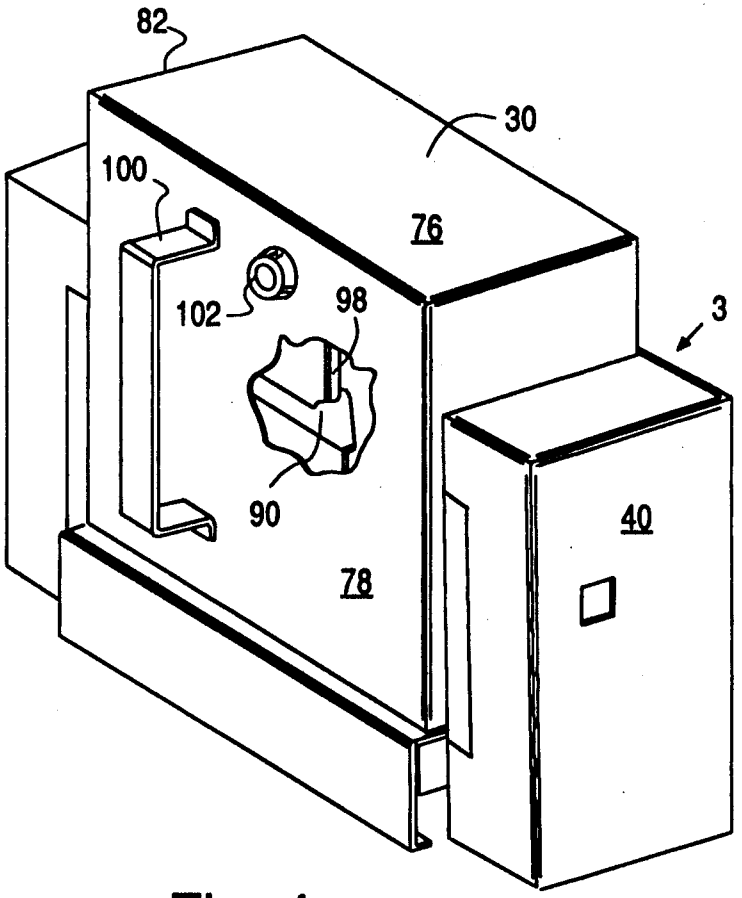
FIG. 4 illustrates the means by which the security box cover is latched onto the security box for removing the security box from the frame.

To now remove security box 4 from frame 3, security box cover 30, shown in FIGS. 1 and 4, is used. Security box cover 30, in the embodiment of FIGS. 1 and 4, provides essentially a four-sided enclosure having top surface 76, front surface 78, right side 80, and left side 82. The security box cover 30 of FIGS. 1 and 4 has no bottom surface or back surface so that security box cover 30 may be slid over the top of security box 4 and between the sides 44 and 50 of security box 4 and sides 22 and 24 of frame 3. Security box cover 30 may be made of a suitable sheet metal.

When security box cover 30 is slid over security box 4 and between the sides of security box 4 and frame 3 in the direction of arrow 32 in FIG. 1, left side 82 and right side 80 of security box cover 30 pushes the latches, such as latches 14 and 16, protruding from the sidewalls of frame 3 into their respective spring housings 38 and 40 so as to release security box 4 from these latches.

Figure 5C:
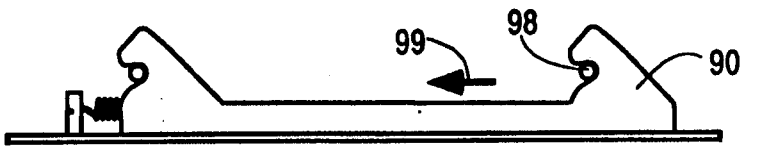
FIGS. 5*a* through 5*c* show, in sequence, the operation of the latching means provided on the security box cover when latching onto the security box.
Figure 5B:
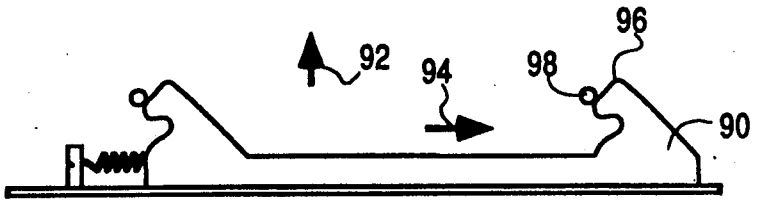
Figure 5A:
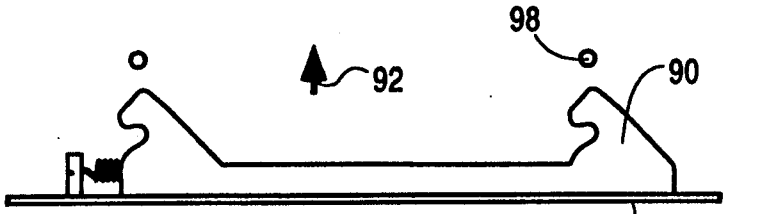

As shown in FIGS. 4 and 5, security box cover 30 contains a spring-loaded sliding latch 90, slidably mounted to its front surface 78. When security box cover 30 is sufficiently slid over security box 4 and pushed in the direction of arrow 92 in FIGS. 5*a* and 5*b*, sliding latch 90 is displaced in the direction of arrow 94 in FIG. 5*b* due to the interaction of angled edges 96 and vertical rods 98, rods 98 being connected to security box 4 as shown in FIGS. 1 and 2.

As security box cover 30 is further slid into place over security box 4, spring-loaded latch 90, after riding over rods 98, then automatically latches onto rods 98 in the direction of arrow 99 in FIG. 5*c*. It will be apparent that other latching or securing means may be used.

The position of FIG. 5*c* is shown in the cutaway view of FIG. 4, where security box cover 30 is now secured to the security box by means of latch 90 and rods 98. Thus, security box cover 30 is now secured to security box 4, and security box 4 is unlatched from frame 3 for removal from frame 3.

Security box 4 may then be removed from frame 3 by pulling security box cover handle 100 to enable easy carrying of security box 4 to a remote location where security box 4 may be unlatched from security box cover 30 to gain access to the currency in security box 4. Such unlatching may be accomplished by dialing the appropriate combination for lock 102, which when turned causes slidable latch 90 to disengage from rods 98.

As will be apparent, combination lock 102 may be replaced by a key lock or other locking mechanism. It will be apparent to those of ordinary skill in the art that many mechanisms may be used to cause latch 90 to be unlatched from rods 98 upon actuation of any locking device. One mechanism may include a well known type lever means or gear means connected to lock 102 which, when actuated by unlocking security box cover 30, would cause slidable latch 90 to slide in the direction of arrow 94 in FIG. 5*b* to release security box cover 30 from box 4.

Thus, a preferred embodiment of the invention has been disclosed. It will be apparent to those of ordinary skill in the art that the various latches discussed with respect to the preferred embodiment may be replaced by other latches for accomplishing a similar purpose. Further, the various latches may be incorporated on the security box itself rather than on the frame or cover. The various structures described may also have any suitable size or shape while still performing the functions described in this specification.

While particular embodiments of the present invention have been shown and described, it will be obvious to those skilled in the art that changes and modifications may be made without departing from this invention in its broader aspects and, therefore, the appended claims are to encompass within their scope all such changes and modifications as followed in the true spirit and scope of this invention.

We claim:

1. A security structure comprising:

a support structure;

a security box means for being supported by said support structure and secured with respect to said support structure by a securing means, said security box means having an access means through which contents of said security box means may be accessed; and a security box cover means, separate and detachable from said security box means, for being positioned relative to said security box means when said security box means is supported by said support structure to block said access means so as to prevent access to said contents of said security box means by unauthorized persons, wherein positioning of said security box cover means relative to said security box means to block said access means also enables removal of said security box means from said support structure, and wherein said positioning of said security box cover means relative to said security box means to block said access means also causes said security box cover means to be secured to said security box means so that, after said security box means has been removed from said support structure, said security box cover means prevents access to said contents of said security box means by said unauthorized persons.

2. The security structure of claim 1 further comprising a lock means provided on said security box cover means for enabling only a person authorized to activate said lock means to release said security box cover means from said security box means to gain access to said contents of said security box means.

3. The security structure of claim 2 wherein said securing means is a latch means.

4. The security structure of claim 3 wherein said latch means is connected to said support structure and latches onto a receiving means on said security box means so that said latch means automatically secures said security box means to said support structure upon alignment of said latch means and said receiving means when said security box means is properly positioned relative to said support structure.

5. The security structure of claim 4 wherein said latch means comprises one or more spring-loaded elements protruding from one or more sidewalls of said support structure which enter said receiving means formed in sidewalls of said security box means when said security box means is properly positioned relative to said support structure.

6. The security structure of claim 5 wherein said security box cover means, when positioned to release said security box means from said support structure, automatically releases said latch means from said receiving means by interposing a portion of said security box cover means between said latch means and said receiving means.

7. The security structure of claim 2 wherein said security box cover means is automatically secured to said security box means via a latch means.

8. The security structure of claim 7 wherein said latch means is connected to said security box cover means and interacts with a receiving element on said security box means to automatically secure said security box cover means to said security box means when said security box cover means is properly positioned relative to said security box means for removal of said security box means, and wherein said latch means connected to said security box cover means may only be released from said receiving element on said security box means when said lock means is activated.

9. The security structure of claim 2 wherein said lock means is a combination lock.

10. The security structure of claim 2 wherein said lock means is a key lock.

11. The security structure of claim 1 wherein said positioning of said security box cover means relative to said security box means to block said access means releases said security box means from said support structure to enable removal of said security box means from said support structure.

12. A security structure comprising:

a support structure;

a security box means for being supported by said support structure and secured with respect to said support structure by a securing means, said security box means having an access means through which contents of said security box means may be accessed; and a security box enclosure means, separate and detachable from said security box means, for being positioned relative to said security box means when said security box means is supported by said support structure to substantially enclose said security box means and to block said access means so as to prevent access to said contents of said security box means by unauthorized persons, wherein positioning of said security box enclosure means relative to said security box means to block said access means also enables removal of said security box means from said support structure.

* * * * *